US010487832B2

(12) United States Patent
Ayub et al.

(10) Patent No.: US 10,487,832 B2
(45) Date of Patent: Nov. 26, 2019

(54) METHOD AND APPARATUS FOR PRESSURE EQUALIZATION IN ROTARY COMPRESSORS

(71) Applicant: Lennox Industries Inc., Richardson, TX (US)

(72) Inventors: Shawket Ayub, Plano, TX (US); Brandon Ullrich, Grand Prairie, TX (US)

(73) Assignee: Lennox Industries Inc., Richardson, TX (US)

( * ) Notice: Subject to any disclaimer, the term of this patent is extended or adjusted under 35 U.S.C. 154(b) by 288 days.

(21) Appl. No.: 15/648,575

(22) Filed: Jul. 13, 2017

(65) Prior Publication Data

US 2018/0180047 A1 Jun. 28, 2018

Related U.S. Application Data

(60) Provisional application No. 62/437,975, filed on Dec. 22, 2016.

(51) Int. Cl.
*F04C 23/00* (2006.01)
*F04C 29/00* (2006.01)
(Continued)

(52) U.S. Cl.
CPC ..... *F04C 29/0021* (2013.01); *F04C 23/008* (2013.01); *F04C 28/06* (2013.01);
(Continued)

(58) Field of Classification Search
CPC ..... F04B 2203/0205; F04C 23/008; F04C 2270/07; F04C 2270/19
See application file for complete search history.

(56) References Cited

U.S. PATENT DOCUMENTS 4,286,438 A 9/1981 Clarke
4,820,130 A 4/1989 Eber et al.
(Continued)

FOREIGN PATENT DOCUMENTS

EP 1750348 A2 2/2007
JP S59147959 A 8/1984
JP H09196479 A 7/1997

OTHER PUBLICATIONS

Ullrich, Brandon, "U.S. Appl. No. 15/495,061", filed Apr. 24, 2017.

*Primary Examiner* — Patrick Hamo
(74) *Attorney, Agent, or Firm* — Winstead PC

(57) ABSTRACT

A high side compressor system includes a compressor housing, motor, and a compression chamber. The compression chamber is disposed within the compressor housing. An accumulator is fluidly coupled to the compressor housing via a pressure-equalization tube. A pressure-equalization valve is disposed in the pressure-equalization tube. The pressure-equalization valve closes access to the pressure-equalization tube responsive to an electrical current being applied to the pressure-equalization valve. The pressure-equalization valve is electrically coupled to a compression mechanism such that interruption of electrical current to the compression mechanism interrupts electrical current to the pressure-equalization valve thereby opening the pressure-equalization valve.

20 Claims, 5 Drawing Sheets

(51) Int. Cl.

| | |
|---|---|
| ***F04C 28/28*** | (2006.01) |
| ***F04C 28/24*** | (2006.01) |
| ***H01F 7/06*** | (2006.01) |
| ***F04C 28/06*** | (2006.01) |
| *F04C 29/12* | (2006.01) |
| *H01H 37/52* | (2006.01) |

(52) U.S. Cl.
CPC ..... *F04C 28/24* (2013.01); *F04C 28/28* (2013.01); *H01F 7/06* (2013.01); *F04C 29/12* (2013.01); *F04C 2210/26* (2013.01); *F04C 2240/40* (2013.01); *F04C 2240/804* (2013.01); *F04C 2240/811* (2013.01); *H01H 37/52* (2013.01)

(56) References Cited

U.S. PATENT DOCUMENTS

| | | | | |
|---|---|---|---|---|
| 5,167,491 | A * | 12/1992 | Keller, Jr. ..... | F04C 28/28 417/28 |
| 5,186,613 | A * | 2/1993 | Kotlarek ..... | F04C 28/28 417/291 |
| 6,945,073 | B2 * | 9/2005 | Matsumoto ..... | F04C 18/3564 62/470 |
| 7,086,244 | B2 * | 8/2006 | Yamasaki ..... | F04C 23/001 62/196.2 |
| 7,976,287 | B2 * | 7/2011 | Hwang ..... | F01C 21/0818 417/213 |
| 9,458,848 | B2 * | 10/2016 | Dreiman ..... | F04C 18/0215 |
| 2011/0023535 | A1 * | 2/2011 | Morimoto ..... | C09K 5/045 62/510 |
| 2011/0094752 | A1 | 4/2011 | Hudson et al. | |
| 2015/0128629 | A1 | 5/2015 | Kawano et al. | |

* cited by examiner

METHOD AND APPARATUS FOR PRESSURE EQUALIZATION IN ROTARY COMPRESSORS

CROSS-REFERENCE TO RELATED APPLICATIONS

This patent application claims priority to, and incorporates by reference for any purpose the entire disclosure of, U.S. Provisional Patent Application No. 62/437,975, filed on Dec. 22, 2016.

TECHNICAL FIELD

The present disclosure relates generally to compressor systems utilized in heating, ventilation, and air conditioning (HVAC) applications and more particularly, but not by way of limitation, to methods and systems for balancing pressure across a rotary compressor or any high-side compressor utilizing a pressure-equalization valve and an internal power circuit.

BACKGROUND

Compressor systems are commonly utilized in HVAC applications. Many HVAC applications utilize high-side compressors that include rotary compressors. Rotary compressors are not tolerant to liquid intrusion into the compression mechanism. Additionally, high-side compressors, such as rotary compressors, have difficulty starting when a pressure differential across the compressor is greater than approximately 7 psi. Many high-side compressors, such as rotary compressors, utilize very large accumulators in combination with an additional fluid reservoir to prevent liquid intrusion into the compression mechanism. Presently, no design exists that facilitates pressure equalization across the high-side compressor.

SUMMARY

In one aspect, the present disclosure relates to a rotary compressor system. The rotary compressor system includes a compressor housing. A compression mechanism is disposed within the compressor housing. An accumulator is fluidly coupled to the compressor housing via a pressure-equalization tube. A pressure-equalization valve is disposed in the pressure-equalization tube. The pressure-equalization valve closes access to the pressure-equalization tube responsive to an electrical current being applied to the pressure-equalization valve. The pressure-equalization valve is electrically coupled to the compression mechanism such that interruption of electrical current to the compression mechanism interrupts electrical current to the pressure-equalization valve thereby opening the pressure-equalization valve.

In another aspect, the present disclosure relates to a method of equalizing pressure in a rotary-compressor system. The method includes fluidly coupling a compressor housing to an accumulator via a pressure-equalization tube and arranging a pressure-equalization valve to limit refrigerant flow through the pressure-equalization tube. The pressure-equalization valve closes responsive to an electrical current being applied to the pressure-equalization valve. The pressure-equalization valve is electrically connected such that an interruption of electrical current to a compression mechanism interrupts electrical current to the pressure-equalization valve thereby causing the pressure-equalization valve to open. Pressure across a compressor housing is balanced through the pressure-equalization tube.

In another embodiment, the present disclosure relates to a rotary compressor system. The rotary compressor system includes a compressor housing. A compression mechanism is disposed within the compressor housing. An accumulator is fluidly coupled to the compressor housing via a pressure-equalization tube. A pressure-equalization valve is disposed in the pressure-equalization tube. The pressure-equalization valve closes access to the pressure-equalization tube responsive to an electrical current being applied to the pressure-equalization valve. An overload protection switch is electrically coupled to the compression mechanism and to the pressure-equalization valve. The overload protection switch interrupts electrical current to the compression mechanism and to the pressure-equalization valve thereby opening the pressure-equalization valve.

BRIEF DESCRIPTION OF THE DRAWINGS

For a more complete understanding of the present disclosure and for further objects and advantages thereof, reference may now be had to the following description taken in conjunction with the accompanying drawings in which.

DETAILED DESCRIPTION

Various embodiments will now be described more fully with reference to the accompanying drawings. The disclosure may, however, be embodied in many different forms and should not be construed as limited to the embodiments set forth herein.

Figure 1:
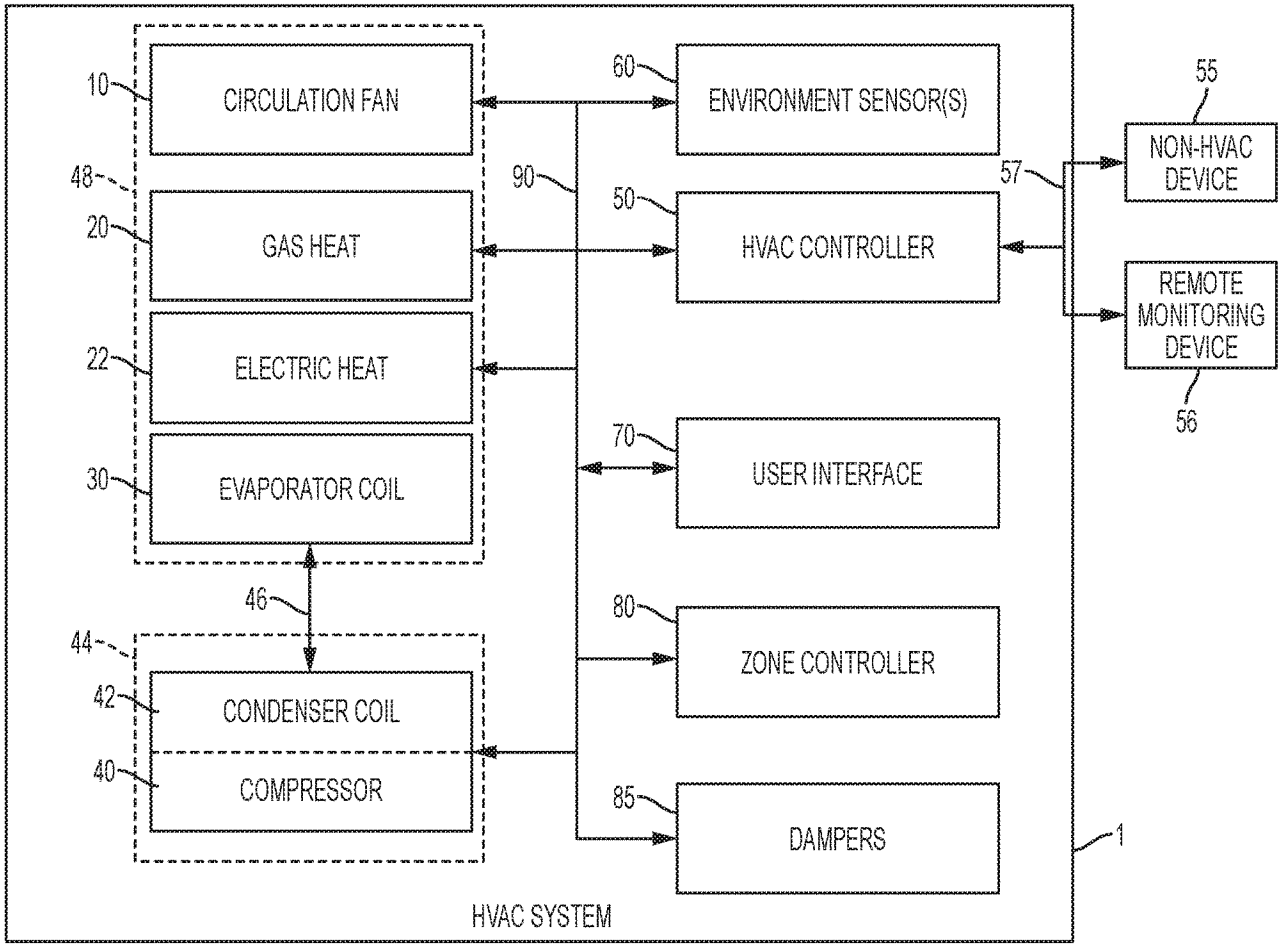
FIG. 1 is a block diagram of an exemplary HVAC system.

FIG. 1 illustrates an HVAC system 1. In a typical embodiment, the HVAC system 1 is a networked HVAC system that is configured to condition air via, for example, heating, cooling, humidifying, or dehumidifying air. The HVAC system 1 can be a residential system or a commercial system such as, for example, a roof top system. For exemplary illustration, the HVAC system 1 as illustrated in FIG. 1 includes various components; however, in other embodiments, the HVAC system 1 may include additional components that are not illustrated but typically included within HVAC systems.

The HVAC system 1 includes a circulation fan 10, a gas heat 20, electric heat 22 typically associated with the circulation fan 10, and a refrigerant evaporator coil 30, also typically associated with the circulation fan 10. In a typical embodiment, the circulation fan 10 may be, for example a single-speed circulation fan or a variable-speed circulation fan. The circulation fan 10, the gas heat 20, the electric heat 22, and the refrigerant evaporator coil 30 are collectively referred to as an "indoor unit" 48. In a typical embodiment, the indoor unit 48 is located within, or in close proximity to, an enclosed space. The HVAC system 1 also includes a compressor 40 and an associated condenser coil 42, which are typically referred to as an "outdoor unit" 44. In a typical embodiment, the compressor 40 may be, for example a fixed-speed compressor or a variable-speed compressor. In various embodiments, the outdoor unit 44 is, for example, a rooftop unit or a ground-level unit. The compressor 40 and the associated condenser coil 42 are connected to an associated evaporator coil 30 by a refrigerant line 46. In a typical embodiment, the compressor 40 is, for example, a single-stage compressor, a multi-stage compressor, a single-speed compressor, or a compressor. Also, as will be discussed in more detail below, in various embodiments, the compressor 40 may be a compressor system including at least two compressors of the same or different capacities. The circulation fan 10, sometimes referred to as a blower, is configured to operate at different capacities (i.e., variable motor speeds) to circulate air through the HVAC system 1, whereby the circulated air is conditioned and supplied to the enclosed space.

Still referring to FIG. 1, the HVAC system 1 includes an HVAC controller 50 that is configured to control operation of the various components of the HVAC system 1 such as, for example, the circulation fan 10, the gas heat 20, the electric heat 22, and the compressor 40. In some embodiments, the HVAC system 1 can be a zoned system. In such embodiments, the HVAC system 1 includes a zone controller 80, dampers 85, and a plurality of environment sensors 60. In a typical embodiment, the HVAC controller 50 cooperates with the zone controller 80 and the dampers 85 to regulate the environment of the enclosed space.

The HVAC controller 50 may be an integrated controller or a distributed controller that directs operation of the HVAC system 1. In a typical embodiment, the HVAC controller 50 includes an interface to receive, for example, thermostat calls, temperature setpoints, blower control signals, environmental conditions, and operating mode status for various zones of the HVAC system 1. In a typical embodiment, the HVAC controller 50 also includes a processor and a memory to direct operation of the HVAC system 1 including, for example, a speed of the circulation fan 10.

Still referring to FIG. 1, in some embodiments, the plurality of environment sensors 60 is associated with the HVAC controller 50 and also optionally associated with a user interface 70. In some embodiments, the user interface 70 provides additional functions such as, for example, operational, diagnostic, status message display, and a visual interface that allows at least one of an installer, a user, a support entity, and a service provider to perform actions with respect to the HVAC system 1. In some embodiments, the user interface 70 is, for example, a thermostat of the HVAC system 1. In other embodiments, the user interface 70 is associated with at least one sensor of the plurality of environment sensors 60 to determine the environmental condition information and communicate that information to the user. The user interface 70 may also include a display, buttons, a microphone, a speaker, or other components to communicate with the user. Additionally, the user interface 70 may include a processor and memory that is configured to receive user-determined parameters, and calculate operational parameters of the HVAC system 1 as disclosed herein.

In a typical embodiment, the HVAC system 1 is configured to communicate with a plurality of devices such as, for example, a monitoring device 56, a communication device 55, and the like. In a typical embodiment, the monitoring device 56 is not part of the HVAC system. For example, the monitoring device 56 is a server or computer of a third party such as, for example, a manufacturer, a support entity, a service provider, and the like. In other embodiments, the monitoring device 56 is located at an office of, for example, the manufacturer, the support entity, the service provider, and the like.

In a typical embodiment, the communication device 55 is a non-HVAC device having a primary function that is not associated with HVAC systems. For example, non-HVAC devices include mobile-computing devices that are configured to interact with the HVAC system 1 to monitor and modify at least some of the operating parameters of the HVAC system 1. Mobile computing devices may be, for example, a personal computer (e.g., desktop or laptop), a tablet computer, a mobile device (e.g., smart phone), and the like. In a typical embodiment, the communication device 55 includes at least one processor, memory and a user interface, such as a display. One skilled in the art will also understand that the communication device 55 disclosed herein includes other components that are typically included in such devices including, for example, a power supply, a communications interface, and the like.

The zone controller 80 is configured to manage movement of conditioned air to designated zones of the enclosed space. Each of the designated zones include at least one conditioning or demand unit such as, for example, the gas heat 20 and at least one user interface 70 such as, for example, the thermostat. The zone-controlled HVAC system 1 allows the user to independently control the temperature in the designated zones. In a typical embodiment, the zone controller 80 operates electronic dampers 85 to control air flow to the zones of the enclosed space.

In some embodiments, a data bus 90, which in the illustrated embodiment is a serial bus, couples various components of the HVAC system 1 together such that data is communicated therebetween. In a typical embodiment, the data bus 90 may include, for example, any combination of hardware, software embedded in a computer readable medium, or encoded logic incorporated in hardware or otherwise stored (e.g., firmware) to couple components of the HVAC system 1 to each other. As an example and not by way of limitation, the data bus 90 may include an Accelerated Graphics Port (ACIP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component interconnect (PCI) bus, a PCI-Express PCI-X) bus, a serial advanced technology attachment (SATA) bus, a Video Electronics Standards Association local (VLB) bus, or any other suitable bus or a combination of two or more of these. In various embodiments, the data bus 90 may include any number, type, or configuration of data buses 90, where appropriate, in particular embodiments, one or more data buses 90 (which may each include an address bus and a data bus) may couple the HVAC controller 50 to other components of the HVAC system 1. In other embodiments, connections between various components of the HVAC system 1 are wired. For example, conventional cable and contacts may be used to couple the HVAC controller 50 to the various components. In some embodiments, a wireless connection is employed to provide at least some of the connections between components of the HVAC system such as, for example, a connection between the HVAC controller 50 and the circulation fan 10 or the plurality of environment sensors 60.

Figure 2:
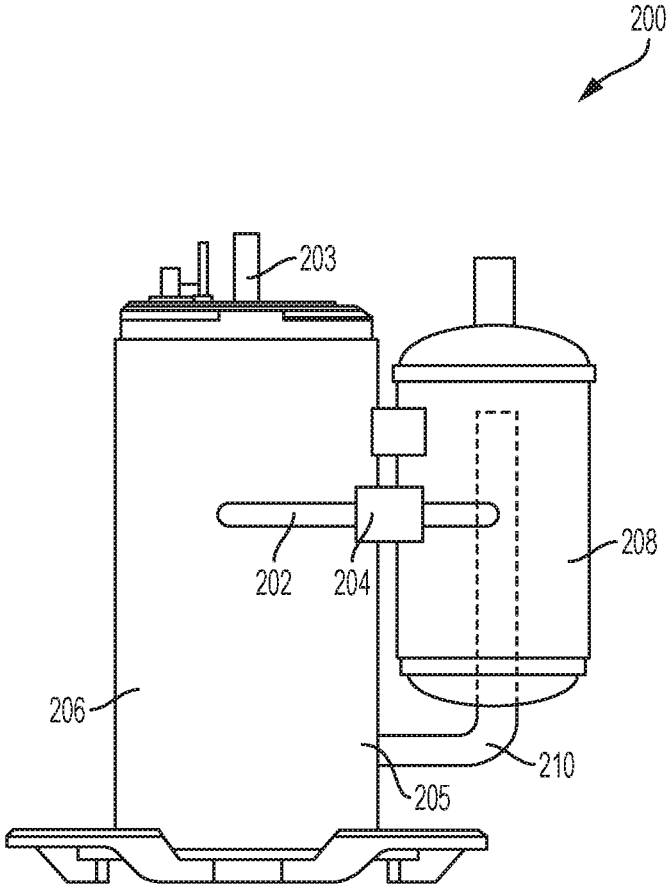
FIG. 2 is a schematic diagram of an exemplary rotary compressor system having a pressure-equalization tube and a pressure-equalization valve.

FIG. 2 is a schematic diagram of a rotary compressor system 200 having a pressure-equalization tube 202 and a pressure-equalization valve 204. For purposes of illustration, FIG. 2 will be discussed herein relative to FIG. 1. The rotary compressor system 200 includes a compressor housing 206. An accumulator 208 is fluidly coupled to the compressor housing 206 via a suction tube 210. The pressure-equalization tube 202 fluidly couples the compressor housing 206 and the accumulator 208. The suction tube 210 couples to the accumulator 208 at a vertical level approximately equal to or above a vertical level where the pressure-equalization tube 202 couples to the accumulator 208. The pressure-equalization valve 204 is disposed so as to open and close access to the pressure-equalization tube 202. In a typical embodiment, the pressure-equalization valve 204 is a solenoid valve; however, in other embodiments, any type of remote-actuated valve could be utilized in accordance with design requirements.

Still referring to FIG. 2, during operation, refrigerant accumulates in the accumulator 208 so as to mitigate ingestion of the refrigerant into the compressor housing 206 via the suction tube 210. During periods when the rotary compressor system 200 is de-activated, the pressure-equalization valve 204 opens thereby allowing pressure on a discharge side 203 of the compressor housing 206 and pressure on a suction side 205 of the compressor housing 206 to equalize. Such pressure equalization establishes a minimal pressure differential across the compressor housing 206 and facilitates re-activation of the rotary compressor system 200. Still referring to FIG. 2, during de-activation of the rotary compressor system 200, a small amount of refrigerant may be drawn into the compressor housing 206 from the accumulator 208. For example, upon deactivation of the rotary compressor system 200, refrigerant present in the accumulator 208 may overflow via at least one of the suction tube 210 and the pressure-equalization tube 202 and be transferred into the compressor housing 206. Upon reactivation of the rotary compressor system 200, refrigerant present in the compressor housing 206 is boiled off due to mechanical and electrical heat produced by the compression mechanism such as, for example, a compressor motor.

Figure 3:
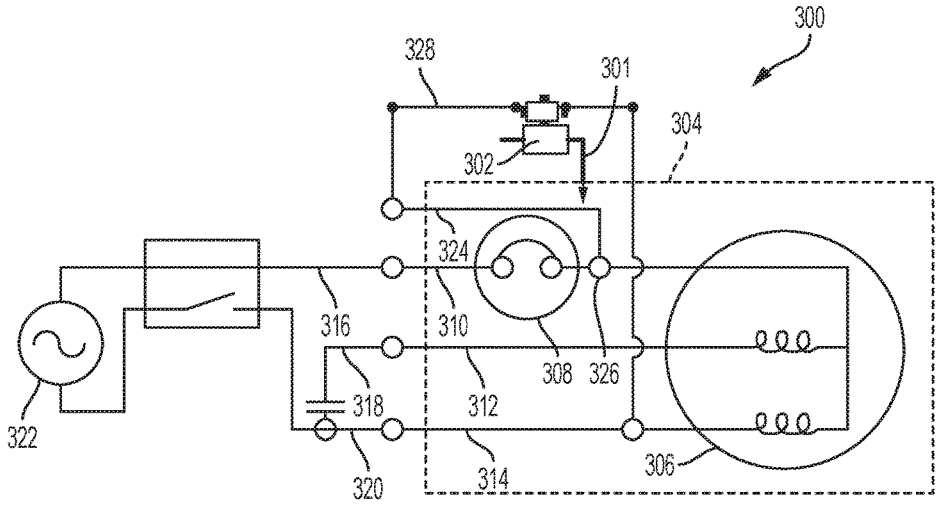
FIG. 3 is a circuit diagram of an exemplary rotary compressor system having an external pressure-equalization valve.

FIG. 3 is a circuit diagram of a rotary compressor system 300 having an external pressure-equalization valve 302. For purposes of illustration, FIG. 3 will be discussed herein relative to FIGS. 1-2. The rotary compressor system 300 includes a compressor housing 304, a compressor motor 306, and an overload protection. switch 308. In a typical embodiment, the overload protection switch interrupts electrical current to the compressor motor 306 during situations where the rotary compressor system 300 is unable to start such as, for example, when a pressure differential across the rotary compressor system 300 is greater than approximately 7 psi. In a typical embodiment, the overload protection switch 308 is a hi-metallic switch that is sensitive to heat generated inside the compressor housing 304; however, in other embodiments, other types of current-interrupt devices could be utilized as dictated by design requirements. In the embodiment illustrated in FIG. 3, the pressure-equalization valve 302 is located outside the compressor housing 304.

Still referring to FIG. 3, the compressor housing 304 includes a first terminal 310 that connects to a first electrical lead 316 from a power source 322, a second terminal 312 that connects to a second electrical lead 318 from the power source 322, and a third terminal 314 that connects to a third electrical lead 320 from the power source 322. The first terminal 310, the second terminal 312, and the third terminal 314 provide electrical current to the compressor motor 306. In a typical embodiment, the overload protection switch 308 is disposed to interrupt electrical current between the first terminal 310 and the compressor motor 306.

Still referring to FIG. 3, a fourth terminal 324 branches from a junction 326 with the first terminal 310. The junction 326 is located between the overload protection switch 308 and the compressor motor 306. The fourth terminal 324 is connected to the pressure-equalization valve 302 via an electrical lead 328. In a typical embodiment, when electrical current is supplied to the pressure-equalization valve 302, the pressure-equalization valve 302 closes and prevents flow of refrigerant through the pressure-equalization tube 301. If the overload protection switch 308 interrupts electrical current to the compressor motor 306 via the first terminal 310, electrical current is also interrupted to the pressure-equalization valve 302 via the fourth terminal 324. Interruption of electrical current to the pressure-equalization valve 302 causes the pressure-equalization valve 302 to open thereby equalizing pressure across the compressor housing 304. Equalization of pressure across the compressor housing 304 facilitates re-activation of the rotary compressor system 300 and prevents unnecessary repeated tripping of the overload protection switch 308.

Figure 4:
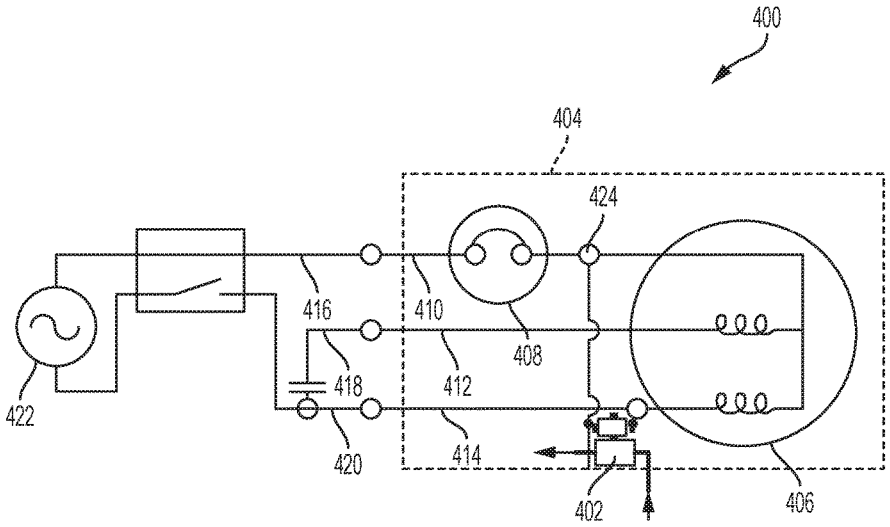
FIG. 4 is a circuit diagram of an exemplary rotary compressor system having an internal pressure-equalization valve.

FIG. 4 is a circuit diagram of a rotary compressor system 400 having an internal pressure-equalization valve 402. For purposes of illustration, FIG. 4 will be discussed herein relative to FIGS. 1-3. The rotary compressor system 400 includes a compressor housing 404, a compressor motor 406, and an overload protection switch 408. In a typical embodiment, the compressor housing 404, the compressor motor 406, and the overload protection switch 408 are similar in construction and operation to the compressor housing 304, the compressor motor 306, and the overload protection switch 308 discussed above with respect to FIG. 3. In the embodiment illustrated in FIG. 4, the pressure-equalization valve 402 is located within the compressor housing 404.

Still referring to FIG. 4, the compressor housing 404 includes a first terminal 410, a second terminal 412, and a third terminal 414 which connect to a first electrical lead 416, a second electrical lead 418, and a third electrical lead 420 from a power source 422, respectively. The first terminal 410, the second terminal 412, and the third terminal 414 provide electrical current to the compressor motor 406. In a typical embodiment, the overload protection switch 408 is disposed to interrupt electrical current to the compressor motor 406 via the first terminal 410. The pressure-equalization valve 402 is electrically connected to the first terminal 410 via a junction 424. In a typical embodiment, the pressure-equalization valve 402 is fluidly coupled to the pressure-equalization tube 202 via a port formed in the compressor housing 404. The junction 424 is located between the overload protection switch 408 and the compressor motor 406. If the overload protection switch 408 interrupts electrical current to the compressor motor 406 via the first terminal 410, electrical current is also interrupted to the pressure-equalization valve 402. Interruption of electrical current to the pressure-equalization valve 402 causes the pressure-equalization valve 402 to open thereby equalizing pressure across the compressor housing 404. Equalization of pressure across the compressor housing 404 facilitates re-activation of the rotary compressor system 400 and prevents unnecessary repeated tripping of the overload protection switch 408.

Figure 5:
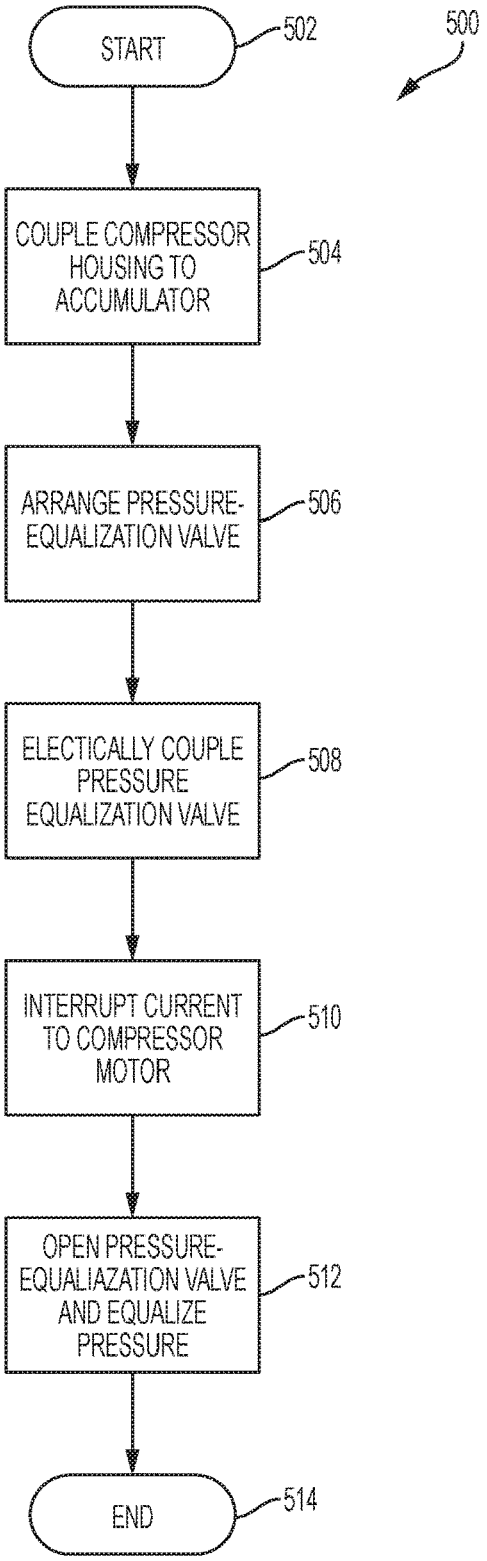
FIG. 5 is a flow diagram illustrating an exemplary process for balancing pressure in a rotary compressor.

FIG. 5 is a flow diagram illustrating a process 500 for balancing pressure in a rotary compressor system. For purposes of illustration, FIG. 5 will be discussed herein relative to FIGS. 1-4. The process starts at step 502. At step 504, the compressor housing 206 is fluidly coupled to the accumulator 208 via a pressure-equalization tube 202. At step 506 a pressure-equalization valve 204 is arranged to limit refrigerant flow through the pressure-equalization tube 202. In a various embodiments, the pressure-equalization valve 204 is located either within the compressor housing 206 or external to the compressor housing 206. In a typical embodiment, the pressure-equalization valve 204 closes access to the pressure-equalization tube 202 responsive to an electrical current being applied to the pressure-equalization valve 204. At step 508, the pressure-equalization valve 204 is electrically coupled to the first terminal 310 at a junction 326 between the overload protection switch 308 and the compressor motor 306. At step 510, electrical current is interrupted to the compressor motor 306 and to the pressure-equalization valve 204 thereby causing the pressure-equalization valve 204 to open. In a typical embodiment, interruption of electrical current to the compressor motor 306 may be caused by tripping of the overload protection switch 308 or by intentional de-activation of the compressor system. At step 512, opening of the pressure-equalization valve 204 allows pressure to equalize across the compressor housing 206 thereby facilitating re-activation of the compressor motor 306. The process 500 ends at step 514.

Depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. Although certain computer-implemented tasks are described as being performed by a particular entity, other embodiments are possible in which these tasks are performed by a different entity.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A rotary compressor system comprising:

a compressor housing;

a compression mechanism disposed within the compressor housing;

an accumulator fluidly coupled to the compressor housing via a pressure-equalization tube;

a pressure-equalization valve disposed in the pressure-equalization tube to limit refrigerant flow through the pressure-equalization tube, the pressure-equalization valve closing access to the pressure-equalization tube responsive to an electrical current being applied to the pressure-equalization valve; and wherein the pressure-equalization valve is electrically coupled to the compression mechanism such that interruption of electrical current to the compression mechanism interrupts electrical current to the pressure-equalization valve thereby opening the pressure-equalization valve.

2. The rotary compressor system of claim 1, wherein the pressure-equalization valve is located outside the compressor housing.

3. The rotary compressor system of claim 2, wherein the pressure-equalization valve is electrically coupled to the compressor housing via a terminal.

4. The rotary compressor system of claim 1, wherein the pressure-equalization valve is located within the compressor housing.

5. The rotary compressor system of claim 4, wherein the pressure-equalization valve is fluidly coupled to a port formed in the compressor housing.

6. The rotary compressor system of claim 1, comprising an overload protection switch disposed in the compressor housing and electrically coupled to the compression mechanism.

7. The rotary compressor system of claim 6, wherein the overload protection switch is a bi-metallic switch responsive to temperature within the compressor housing.

8. The rotary compressor system of claim 5, wherein opening of the overload protection switch interrupts electrical current to the pressure-equalization valve.

9. The rotary compressor system of claim 8, wherein interruption of current to the pressure-equalization valve opens the pressure-equalization valve.

10. The rotary compressor system of claim 1, comprising a suction tube fluidly coupling the accumulator to the compressor housing.

11. The rotary compressor system of claim 10, wherein the suction tube is fluidly coupled to the accumulator at a vertical level approximately equal to or above a vertical level where the pressure-equalization tube couples to the accumulator.

12. The rotary compressor system of claim 1, wherein the pressure-equalization valve is a solenoid valve.

13. A method of equalizing pressure in a rotary-compressor system, the method comprising:

fluidly coupling a compressor housing to an accumulator via a pressure-equalization tube;

arranging a pressure-equalization valve to limit refrigerant flow through the pressure-equalization tube, the pressure-equalization valve closing responsive to an electrical current being applied to the pressure-equalization valve;

electrically connecting the pressure-equalization valve such that an interruption of electrical current to a compression mechanism interrupts electrical current to the pressure-equalization valve thereby causing the pressure-equalization valve to open; and balancing pressure across a compressor housing through the pressure-equalization tube.

14. The method of claim 13, comprising arranging the pressure-equalization valve outside of the compressor housing.

15. The method of claim 13, comprising interrupting current to the pressure-equalization valve responsive to opening of an overload protection switch.

16. The method of claim 15, wherein interrupting current to the overload protection switch opens the pressure-equalization valve.

17. The method of claim 16, comprising arranging the pressure-equalization valve inside of the compressor housing.

18. The method of claim 17, comprising interrupting current to the pressure-equalization valve responsive to opening of an overload protection switch.

19. The method of claim 18, wherein interrupting current to the overload protection switch opens the pressure-equalization valve.

20. A rotary compressor system comprising:

a compressor housing;

a compression mechanism disposed within the compressor housing;

an accumulator fluidly coupled to the compressor housing via a pressure-equalization tube;

a pressure-equalization valve disposed in the pressure-equalization tube, the pressure-equalization valve closing access to the pressure-equalization tube responsive to an electrical current being applied to the pressure-equalization valve;

an overload protection switch electrically coupled to the compression mechanism and to the pressure-equalization valve; and wherein the overload protection switch interrupts electrical current to the compression mechanism and to the pressure-equalization valve thereby opening the pressure-equalization valve.

* * * * *